US011781339B2

(12) United States Patent
Samara et al.

(10) Patent No.: US 11,781,339 B2
(45) **Date of Patent: *Oct. 10, 2023**

(54) PORTABLE RAZOR WIRE RAPID DEPLOYMENT UNIT

(71) Applicant: Allied Tube & Conduit Corporation, Harvey, IL (US)

(72) Inventors: Carmen Samara, Homer Glen, IL (US); Michael Miloshoff, Lowell, IN (US); Raymond Szkola, Harvey, IL (US)

(73) Assignee: Allied Tube & Conduit Corporation, Harvey, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/947,795

(22) Filed: Sep. 19, 2022

(65) Prior Publication Data

US 2023/0019855 A1 Jan. 19, 2023

Related U.S. Application Data

(63) Continuation of application No. 16/832,222, filed on Mar. 27, 2020, now Pat. No. 11,447,973.
(Continued)

(51) Int. Cl.

| | |
|---|---|
| ***E04H 17/26*** | (2006.01) |
| ***F41H 11/10*** | (2006.01) |
| ***F41H 11/08*** | (2006.01) |

(52) U.S. Cl.
CPC ..... *E04H 17/26* (2013.01); *F41H 11/08* (2013.01); *F41H 11/10* (2013.01)

(58) Field of Classification Search
CPC ..... F41H 11/08; F41H 11/10; E04H 17/003; E04H 17/04; E04H 17/16; E04H 17/20;
(Continued)

(56) References Cited

U.S. PATENT DOCUMENTS

| | | | |
|---|---|---|---|
| 3,070,946 | A | 1/1963 | Kirsch et al. |
| 3,463,455 | A | 8/1969 | Meckel |

(Continued)

FOREIGN PATENT DOCUMENTS

| | | | |
|---|---|---|---|
| CH | 179142 | A | 8/1935 |
| CN | 201806360 | U | 4/2011 |

(Continued)

OTHER PUBLICATIONS

Extended European Search Report for Application No. 20168227.5, dated Aug. 24, 2020, 7 pages.

(Continued)

*Primary Examiner* — Matthew R McMahon
(74) *Attorney, Agent, or Firm* — KDW FIRM PLLC

(57) ABSTRACT

A razor wire rapid deployment unit (RDU)/barrier is disclosed. In some embodiments, the RDU includes an enclosure having a first section coupleable with a second section, the enclosure defining an interior area therein. The RDU may further include a razor wire disposed within the interior area of the enclosure, a first end of the razor wire directly coupled to the first section, and a second end of the razor wire directly coupled to the second section. The first and second sides of the enclosure may be separated from one another to deploy the razor wire from a compressed configuration to an expanded configuration.

15 Claims, 11 Drawing Sheets

Related U.S. Application Data

(60) Provisional application No. 62/830,613, filed on Apr. 8, 2019.

(58) Field of Classification Search
CPC ..... E04H 17/22; E04H 17/26; E04H 17/261; E04H 17/266; E04H 17/045; E01F 13/02; E01F 13/022; E01F 13/12
See application file for complete search history.

(56) References Cited

U.S. PATENT DOCUMENTS

| | | | | |
|---|---|---|---|---|
| 4,484,729 | A | 11/1984 | Mainiero et al. | |
| 5,536,109 | A * | 7/1996 | Lowndes | E01F 13/04 404/9 |
| 5,996,504 | A | 12/1999 | Lowery | |
| 7,290,756 | B2 | 11/2007 | Pavlov | |
| 7,481,444 | B1 | 1/2009 | Pavlov | |
| 7,850,392 | B2 * | 12/2010 | Schubert | E01F 13/12 404/6 |
| 7,896,317 | B2 | 3/2011 | Pavlov | |
| 7,909,309 | B2 | 3/2011 | Major et al. | |
| 8,157,491 | B2 | 4/2012 | Pavlov | |
| 10,458,146 | B2 | 10/2019 | Masserant | |
| 11,066,845 | B2 | 7/2021 | Beagen et al. | |
| 11,111,642 | B2 * | 9/2021 | Creaven | F41H 11/10 |
| 2006/0022184 | A1 | 2/2006 | Pavlov | |
| 2013/0327666 | A1 | 12/2013 | Fuerus et al. | |
| 2019/0308771 | A1 | 10/2019 | Howe et al. | |

FOREIGN PATENT DOCUMENTS

| | | | | |
|---|---|---|---|---|
| CN | 103415753 | A | 11/2013 | |
| CN | 203716631 | U | 7/2014 | |
| CN | 206158342 | U | 5/2017 | |
| CN | 206769552 | U | 12/2017 | |
| CN | 208847033 | U | 5/2019 | |
| GB | 2187491 | A | 9/1987 | |
| TW | M389251 | U | 9/2010 | |
| WO | WO-2007067026 | A1 * | 6/2007 | E01F 13/028 |
| WO | 2007078307 | A2 | 7/2007 | |
| WO | 2013167861 | A2 | 11/2013 | |

OTHER PUBLICATIONS

EP Extended Search Report dated Oct. 21, 2022, for the EP Patent Application No. EP22185444,.1 filed on Apr. 36, 2020, 6 pages.

* cited by examiner

PORTABLE RAZOR WIRE RAPID DEPLOYMENT UNIT

CROSS-REFERENCE TO RELATED APPLICATION

This is a continuation application of U.S. application Ser. No. 16/832,222, filed Mar. 27, 2020, which is a non-provisional of U.S. provisional application Ser. No. 62/830,613, filed Apr. 8, 2019, the entirety of which applications are incorporated by reference herein.

FIELD OF THE DISCLOSURE

The present disclosure relates generally to access security and, more particularly, to a portable razor wire rapid deployment unit (RDU) for access security.

DISCUSSION OF RELATED ART

Many barriers exist for providing a deterrent to ingress into and/or egress from a secured area. One known apparatus is a barbed or razor wire fence comprised of a plurality of strands of spaced wires supported by a plurality of horizontally spaced posts. Another known apparatus is a mesh wire fence, which may also be supported by a plurality of horizontally spaced posts. Each apparatus may also be topped by a plurality of strands of barbed/razor wire inclined at an angle towards the outside of the secured area and, in some instances, a plurality of strands of barbed/razor wire inclined at an angle towards the inside of the secured area. Such angularly oriented strands of barbed/razor wire are provided for preventing a human from climbing the security fence and then climbing upwardly over the top of the security fence. In other known apparatuses, one or more layers of concertina razor wire may be coupled to a fence.

Furthermore, transportable or movable barriers for defining a confined or protected area, and which can be rapidly deployed, are well known. Typically, such barriers include one or more concertina coils which are stored in a compressed fashion and axially extended to deploy. The concertina coils may be constructed from a variety of diameters and include a variety of barbed configurations.

However, several problems or drawbacks are associated with known rapidly deployable barriers. For example, use of larger deployment units may require multiple personnel to move in and out of place, and/or use motorized vehicles for deployment. Meanwhile, deployment of smaller concertina wire may be done by manually handling the wire itself, which can be dangerous. Accordingly, a rapidly deployable barrier which has improved mobility and performance is desired.

SUMMARY OF THE DISCLOSURE

In view of the foregoing, in one or more embodiments, a razor wire rapid deployment unit (RDU) may include an enclosure having a first section coupleable with a second section, the enclosure defining an interior area therein. The razor wire RDU may further include a razor wire disposed within the interior area of the enclosure, wherein a first end of the razor wire is directly coupled to the first section, and wherein a second end of the razor wire is directly coupled to the second section. The first and second sections of the enclosure are separable from one another to deploy the razor wire from a compressed configuration to an expanded configuration.

In one or more embodiments, an assembly may include an enclosure having a first section coupleable with a second section, and a concertina razor wire housed within an interior area of the enclosure, wherein a first end of the concertina razor wire is directly coupled to the first section, wherein a second end of the concertina razor wire is directly coupled to the second section, and wherein the first and second sections of the enclosure are separable from one another to expand and compress the concertina razor wire.

In one or more embodiments, a method of deploying a razor wire may include providing an enclosure having a first section coupleable with a second section, the enclosure defining an interior area therein. The method may further include housing a razor wire within the interior area of the enclosure, wherein a first end of the razor wire is directly coupled to the first section, and wherein a second end of the razor wire is directly coupled to the second section. The method may further include moving the first and second sections relative to one another to expand or compress the razor wire.

BRIEF DESCRIPTION OF THE DRAWINGS

The accompanying drawings illustrate exemplary approaches of the disclosure, including the practical application of the principles thereof, and in which.

Figure 1:
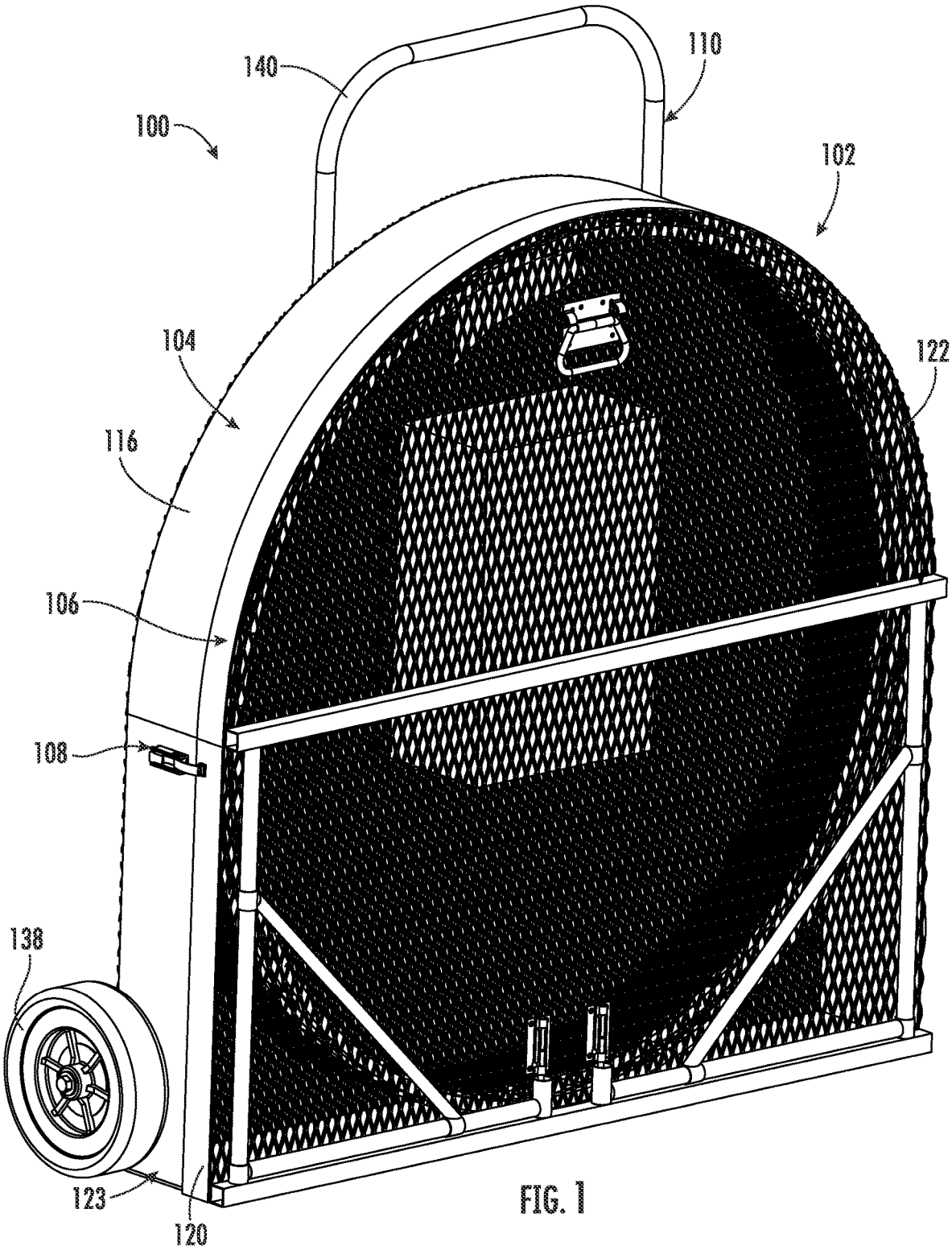
FIG. 1 is a first perspective view of a razor wire rapid deployment unit (RDU) according to exemplary approaches of the disclosure.
Figure 2:
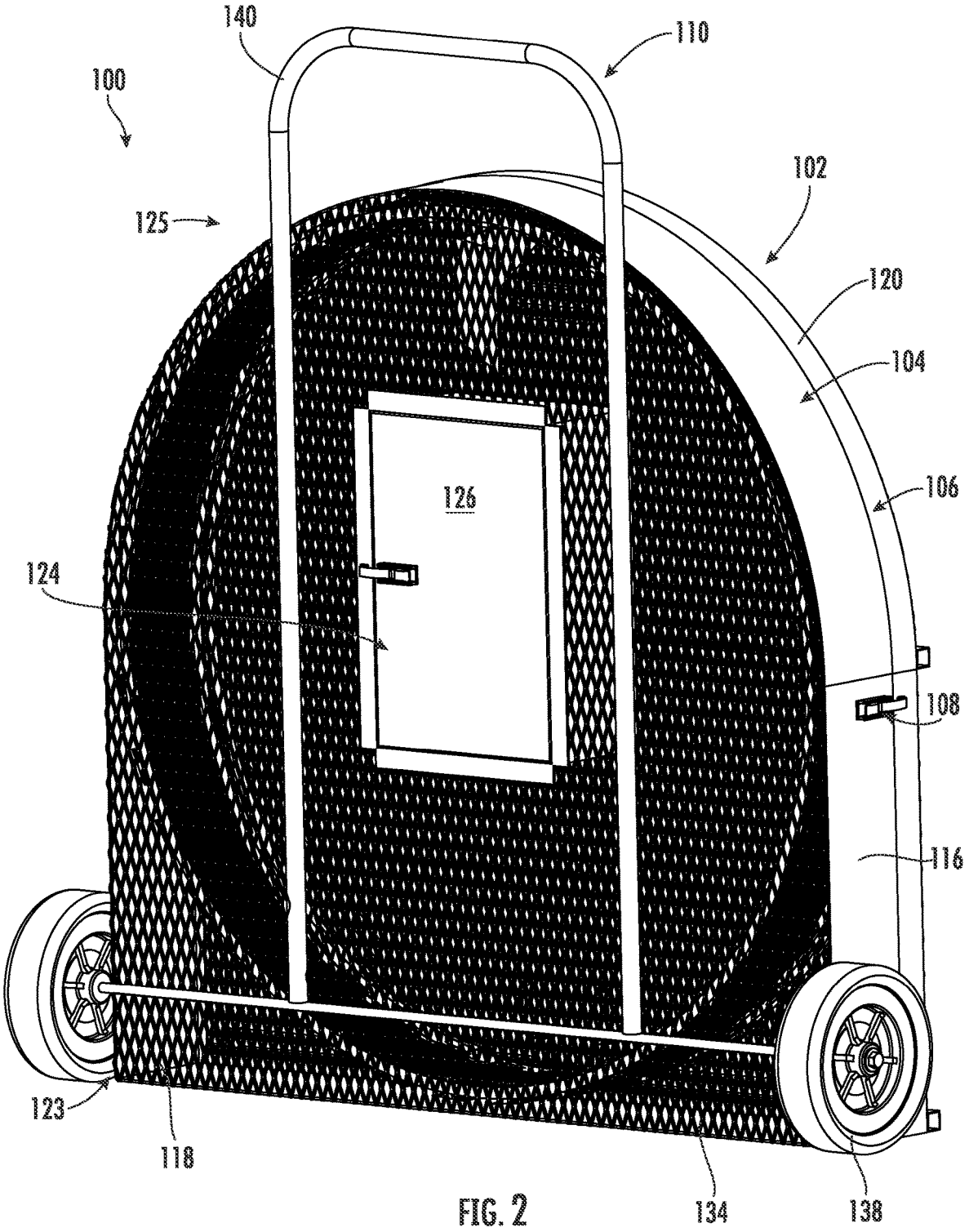
FIG. 2 is a second perspective view of the razor wire RDU of FIG. 1 according to exemplary approaches of the disclosure.

The drawings are not necessarily to scale. The drawings are merely representations, not intended to portray specific parameters of the disclosure. Furthermore, the drawings are intended to depict exemplary embodiments of the disclosure, and therefore is not considered as limiting in scope.

Furthermore, certain elements in some of the figures may be omitted, or illustrated not-to-scale, for illustrative clarity. The cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DETAILED DESCRIPTION

The present disclosure will now proceed with reference to the accompanying drawings, in which various razor wire assemblies or rapid deployment units (RDUs) and methods for deploying are shown. It will be appreciated, however, that the disclosed RDUs may be embodied in many different forms and should not be construed as limited to the approaches set forth herein. Rather, these approaches are provided so that this disclosure will be thorough and complete, and will fully convey the scope of the disclosure to those skilled in the art. In the drawings, like numbers refer to like elements throughout.

Embodiments of the present disclosure provide a barrier, which deploys rapidly to create a perimeter in a short period of time using less labor to secure the perimeter. In some embodiments, wheels permit easier maneuverability of the barrier to a desired site. During transport, the wire (e.g., concertina) may be contained within a housing, thus allowing for minimal direct handling by operators. The enclosure also provides for retrieval of the wire back into the enclosure after deployment, which allows for the wire to be reused, i.e., redeployed, multiple times.

More specifically, the RDUs of the present embodiments, provide a complete enclosure of the wire during transit and positioning at site. The wire is attached at either or both ends to the box-like housing so that the concertina wire can be deployed while holding onto one section of the housing so that special safety equipment is not needed to handle the concertina wire. Wheels may permit easy movement of one or both sections of the housing, thus allowing one person to deploy rapidly and permit retrieval of concertina wire. The sections or halves of the enclosure may be locked or staked after deployment to permit stable positioning of concertina wire. The enclosure may be secured together using, for example, using one or more fasteners.

Figure 3:
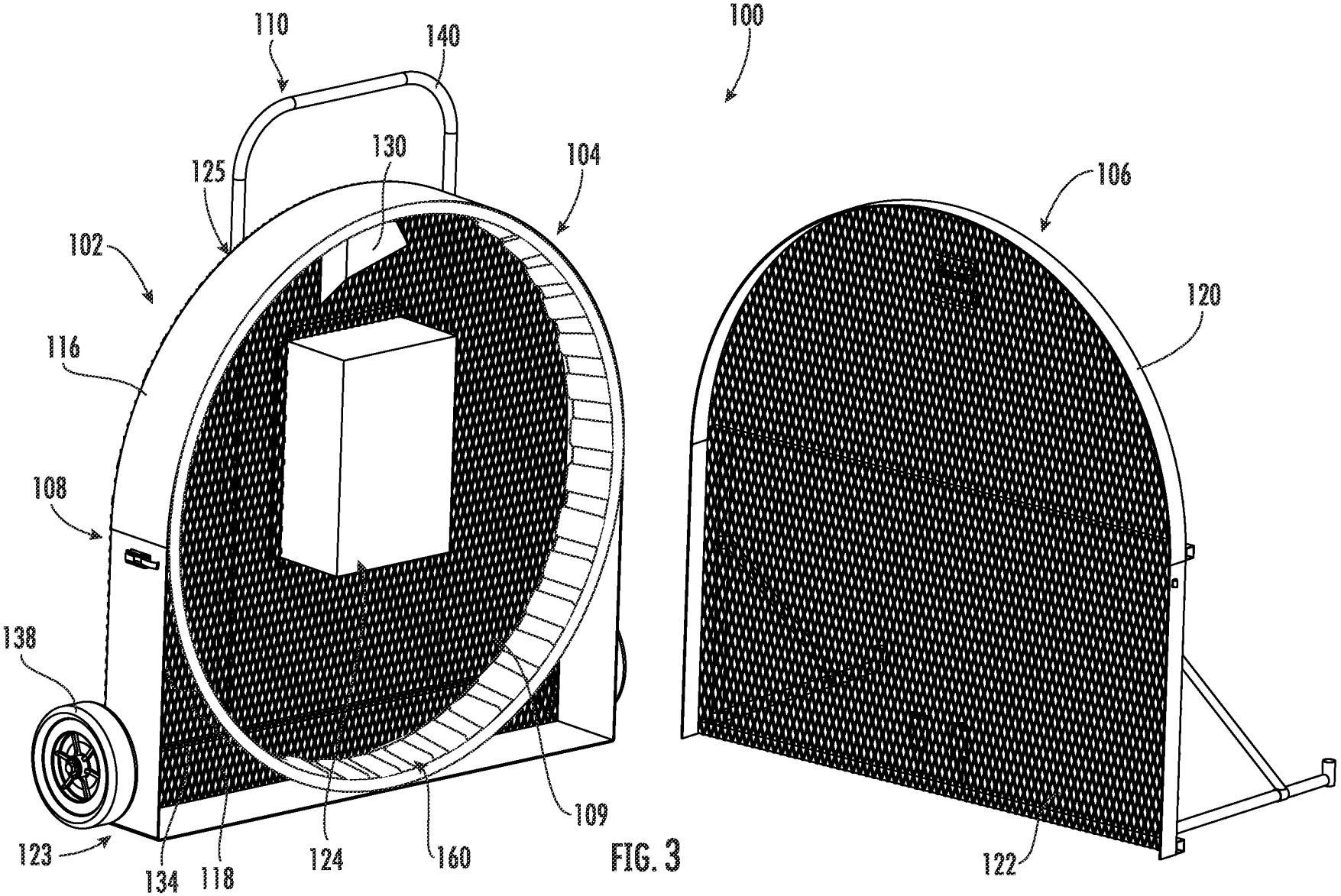
FIG. 3 is a perspective view of the razor wire RDU of FIG. 1 with first and second sections separated, according to exemplary approaches of the disclosure.

Referring now to FIGS. 1-4, a razor wire assembly or razor wire RDU (hereinafter "assembly") 100 will be described in greater detail. As shown, the assembly 100 may include a housing or enclosure 102 having a first section 104 coupleable with a second section 106. Together, the first section 104 and the second section 106 define an interior area 109, as best shown in FIG. 3, which houses a razor wire 160 therein. In a closed position, the first and second sections 104, 106 may be joined together by one or more fasteners 108.

As shown, the first section 104 may include a first outer frame 116 defining a perimeter around the razor wire 160. In some embodiments, a first mesh panel 118 may extend across the first outer frame 116. Although non-limiting, the first mesh panel 118 may be a metal wire panel directly coupled to the first outer frame 116. The second section 106 may similarly include a second outer frame 120 and a second mesh panel 122 extending across the second outer frame 120. As shown, the first outer frame 116 and the second outer frame 120 may generally have the complimentary shapes.

In some embodiments, the first mesh panel 118 and the second mesh panel 122 may each be arranged as a first plurality of wire strands positioned across a second plurality of wire strands. In some embodiments, the first and second plurality of wire strands and may be interwoven. In other embodiments, the first plurality of wire strands may not be interwoven with the second plurality of wire strands and, instead, may be positioned directly adjacent one another. In yet other embodiments, the first and second plurality of wire strands and are integrally formed. Although shown in a crisscross diamond configuration, it'll be appreciated that the first and second plurality of wire strands and may also be oriented perpendicular to one another in other embodiments.

As further shown, the first section 104 may include a receptacle 124 (e.g., tool box) extending through the first mesh panel 118 and into the interior area 109 of the enclosure 102. In some embodiments, a cover 126 of the receptacle 124 may be generally planar with the first mesh panel 118. In some embodiments, the receptacle 124 may alternatively be formed through the second mesh panel 122.

Figure 4:
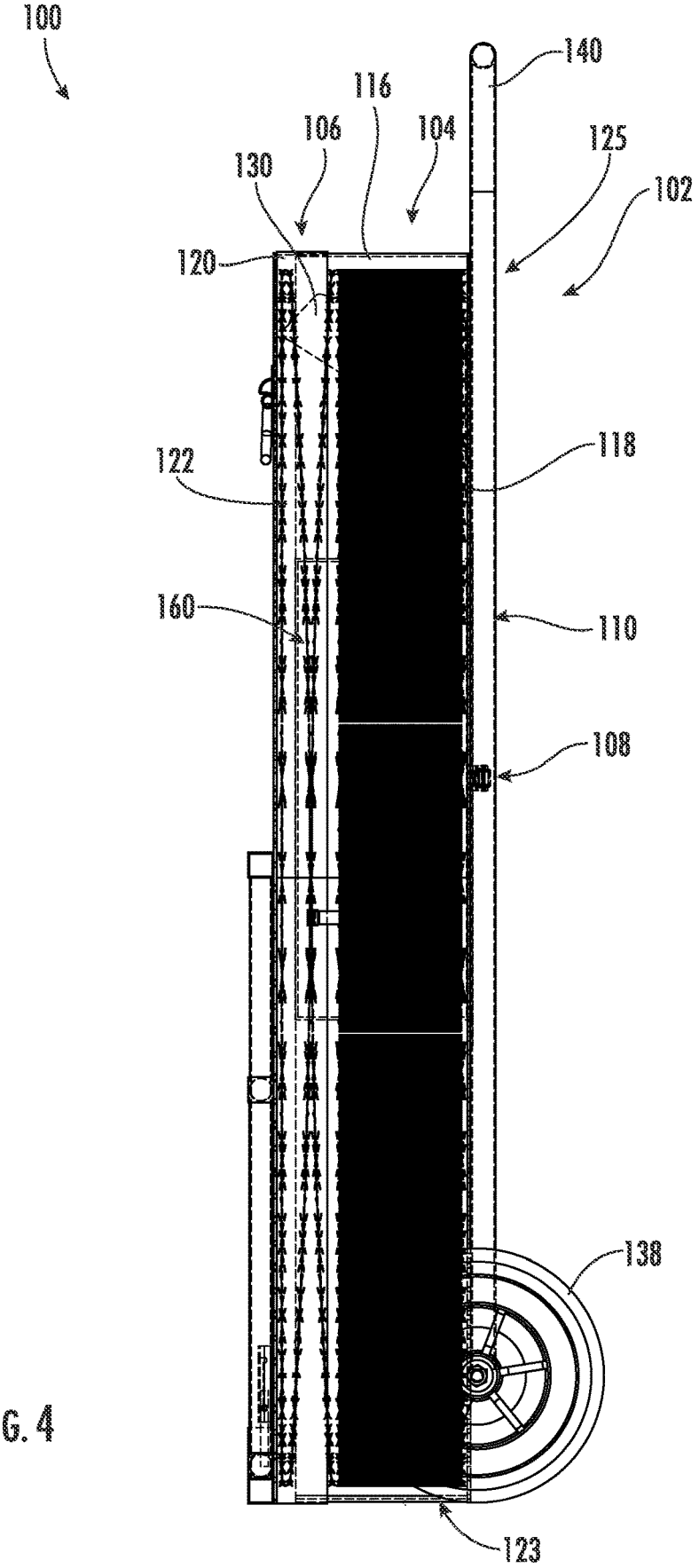
FIG. 4 is a side cross-sectional view of the razor wire RDU of FIG. 1 according to exemplary approaches of the disclosure.

As best shown in FIGS. 3-4, the first section 104 may include a wire support 130 extending from the first mesh panel 118 and/or the first outer frame 116. In some embodiments, the wire support 130 may generally extend perpendicular to the first mesh panel 118 and into the interior area 109 of the enclosure 102. The wire support 130 may have a free end that extends towards the second mesh panel 122. As shown, the razor wire 160 may be retained on the wire support 130 when the razor wire 160 is in the compressed configuration. Furthermore, the wire support 130 may keep the razor wire 160 from sagging or otherwise deforming within the enclosure 102, thus making the razor wire 160 easier to deploy and then retrieve following deployment.

Referring again to FIGS. 1-4, the assembly 100 may include a transport frame 110 directly coupled to an exterior surface of the first mesh panel 118. In other embodiments, the transport frame 110 may be directly coupled to the first outer frame 116. As shown, the transport frame 110 may include a base frame 134 coupled to a lower portion 123 of the first section 104, wherein a set of wheels 138 may be coupled to the base frame 134. The transport frame 110 may further include a main frame 140 coupled to the base frame 134, the main frame 140 extends vertically between the lower portion 123 and an upper portion 125 of the first section 104 of the enclosure 102. As shown, the main frame 140 may extend above the upper portion 125 of the first section 104 to serve as a handle for an operator of the assembly 100.

Figure 5:
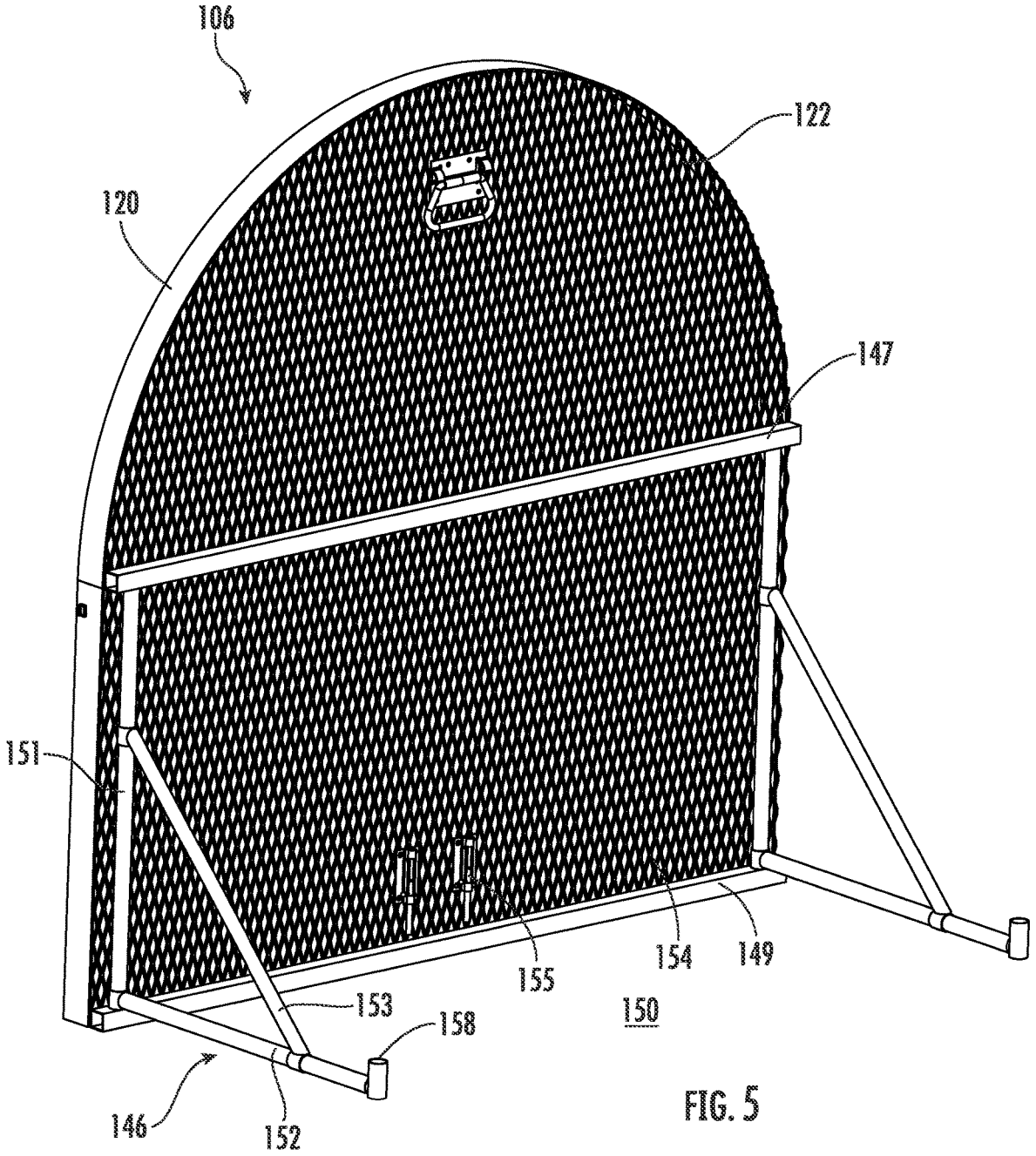
FIG. 5 is a perspective view of the second section of the razor wire RDU of FIG. 1 according to exemplary approaches of the disclosure.

Turning now to FIG. 5, the second section 106 of the assembly 100 will be described in greater detail. As shown, the second section 106 may include first and second cross supports 147, 149 extend across the second outer frame 120. A pair of anchor components 146 may be rotatably coupled to the first and second cross supports 147, 149. Although non-limiting, the anchor components 146 may include a first tube 151 extending between the first and second cross supports 147 and 149, and a second tube 152 extending from a base of the first tube 151. A third tube 153 may extend between the first and second tubes 151, 152 to provide support to the anchor components 146. As shown, the second tube 152 may further include an opening or channel 158 to receive a fastener, spike, or anchor therein. The anchor components 146 may be secured to a ground surface 150.

In some embodiments, the anchor components 146 may initially be secured to an exterior 154 of the second mesh panel 122 in a first configuration by one or more fasteners or latches 155 (e.g., slide bolt latches). Once the second section 106 is brought to an intended position, the anchor components 146 may be swung outwardly from the second mesh panel 122 until the anchor components 146 extend perpendicularly.

Figure 6:
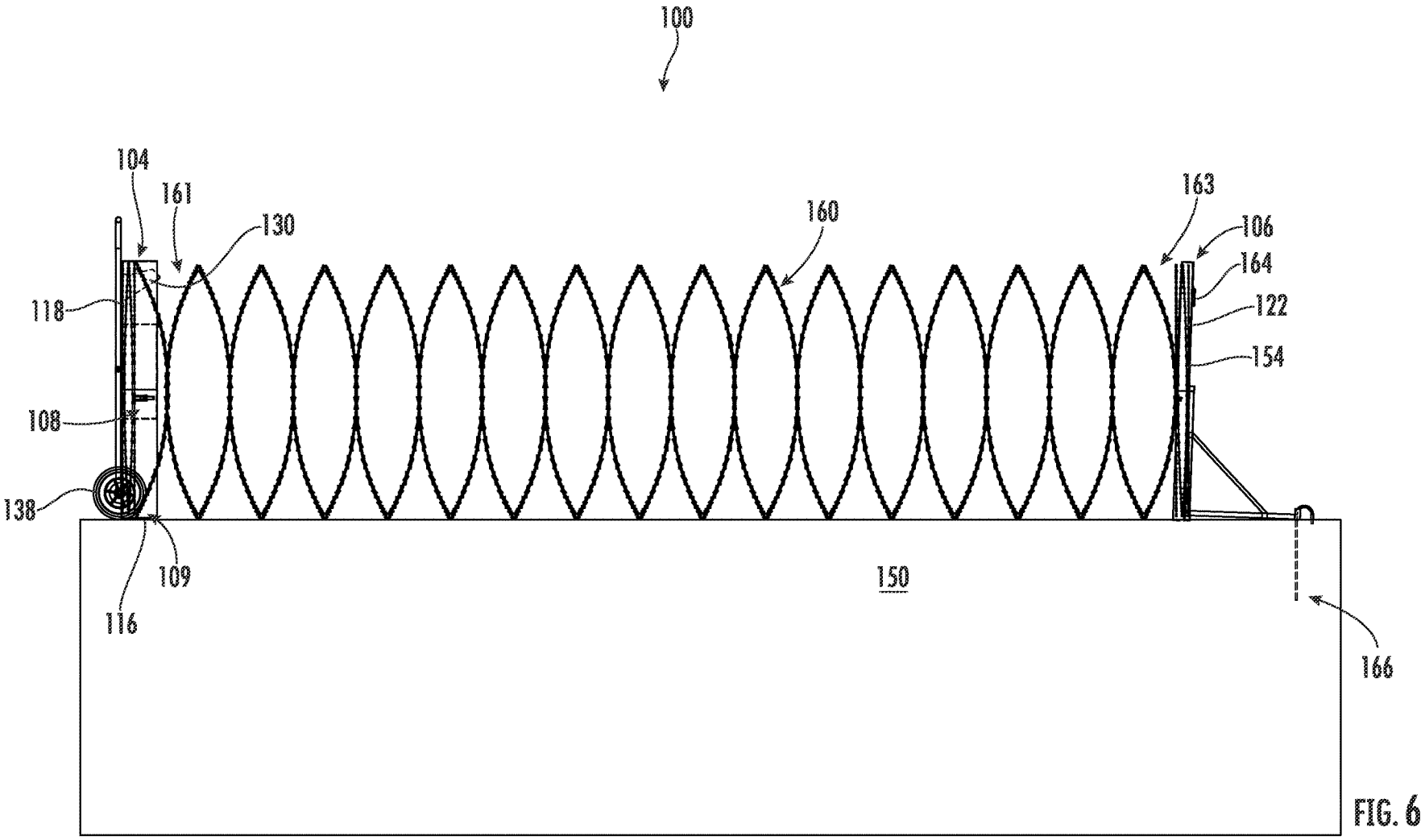
FIG. 6 is a side view of the razor wire RDU of FIG. 1 in an expanded configuration according to exemplary approaches of the disclosure.

Turning now to FIG. 6, the assembly 100 according to embodiments of the present disclosure will be described in greater detail. The razor wire 160 may be a concertina coil having a first end 161 directly secured to an interior surface of the first section 104 of the enclosure 102, and a second end 163 directly secured to an interior surface of the second section 106 of the enclosure 102. More specifically, the first end 161 may be coupled to the first mesh panel 118 of the first section 104, while the second end 163 may be coupled to the second mesh panel 122 of the second section 106. In some embodiments, the razor wire 160 is molded to the first and second sections 104, 106. In other embodiments, the razor wire 160 is coupled to the first and second sections 104 and 106, for example, by one or more fasteners, clips, retainers, etc. In some embodiments, more than one razor wire 160 is present within the enclosure 102. In the non-limiting illustrated embodiments, the concertina coil of the razor wire 160 may have a diameter of at least 48 inches in its deployed configuration.

During use, the assembly 100 may be transported to an intended site in a closed configuration in which the first and second sections 104, 106 of the enclosure 102 are secured together. The fasteners 108 of the enclosure 102 may be disconnected, and the second section 106 may be maneuvered into positioned, for example, using a handle 164 located along the exterior 154 of the second mesh panel 122. The second section 106 may then be secured in place, for example, by one or more anchor components 166 inserted into the ground surface 150. Although non-limiting, the anchor components 166 may be between about 18 inches and 24 inches in length.

The operator may then move the first section 104 away from the second section 106, thus deploying the razor wire 160 into a desired, expanded configuration. The set of wheels 138 may make it easier for the first section 104 to be pulled along the ground surface 150. Although not shown, one or more additional anchors may be used to secure the first section 104 in place once the razor wire 160 is deployed. When it is time to break down the assembly 100 for subsequent transport, the operator may simply remove the additional anchors and walk the first section 104 back towards the second section 106. Due to the elasticity of the razor wire 160, the razor wire 160 may be uniformly compressed back into position within the interior area 109 of the first outer frame 116. As stated above, the razor wire 160 may be looped around the wire support 130. In other embodiments, the assembly 100 may also be used to transport used concertina wire that no longer can be compressed back into the enclosure 102.

As used herein, "razor wire" may be interchangeably known as razor ribbon, ribbon tape, or barbed tape. The razor wire can be either wire reinforced tape or non-reinforced barbed tape. Concertina coil formed of combinations of wire reinforced and non-reinforced tape may also be used. Wire reinforced tape is available in short, medium or long barb and can be fabricated from galvanized steel, stainless steel or the like. Although only a single helical concertina coil is shown, double concertina coils are also available. The barbed tape may be formed by dynamic rolling to provide for barb stiffening.

Figure 7:
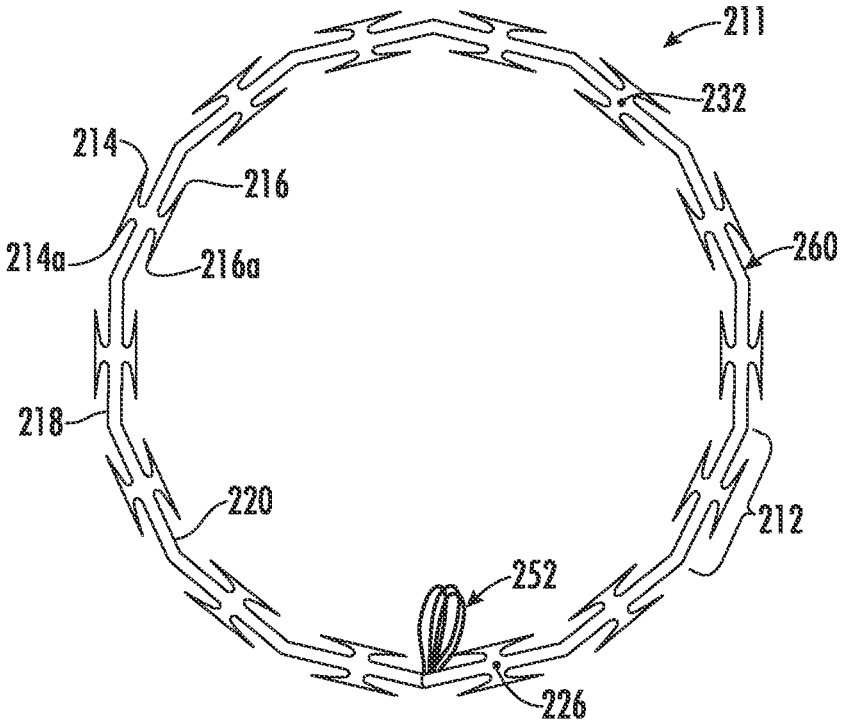
FIGS. 7-10 demonstrate various razor wires according to exemplary approaches of the disclosure.

Turning now to FIG. 7, an example razor wire 260, or barbed tape, according another embodiment of the present disclosure will be described in greater detail. It will be appreciated that the razor wire 260 may be employed in the assembly 100 described herein. As shown, the razor wire 260 may be a barbed tape fabricated from linear, substantially planar, flat metal strip stock. The barbed tape has a continuous series of closed loops or turns normally defining a helical coil 211 with each closed turn preferably having adjoining equally angularly offset linear segments of equal length. Each turn of coil 211 may be formed as to be readily retracted into stacked confronting, nesting, collapsed relation to its adjoining connected turns.

The razor wire 260 may be constructed with identical barb clusters each having four needle-sharp barbs with each four-barb cluster having two-barb pairs 214, 214*a* and 216, 216*a* spaced opposed along opposite tape edges 218 and 220. The plane of the razor wire 260 will be understood to contain the longitudinally extending outside and inside tape edges 218 and 220. For example, each barb pair may be 2.375 inches long and equally spaced apart on about four inch centers repeatedly along the length of the razor wire 260 dimensioned, e.g., to be 0.025 inches thick and about 1.195 inches wide at the maximum width of the tape across barbs and fabricated for general purpose use, say, with 24, 30, 40, 48, 50, and 60 inch diameter turns. Embodiments herein are not limited to any particular size or configuration, however. Such tape may be fabricated from flat strip stock of high carbon steel and is particularly suited to be formed from austenitic stainless steel 0.025 inch thick, e.g., hardened to Rockwell 30 N, 50-70.

The barb clusters are positioned in precise corresponding relation to one another along each turn of coil 211 such that linear segments 212 and their barb clusters of each closed turn of the coil may be positioned in face-to-face contact engagement with corresponding elements of their connected adjacent turns throughout their entire length when the turns are retracted to nest in an axially aligned arrangement.

The razor wire 260 may initially be formed with oriented barbs, and the strip is then edge bent in the plane of the razor wire 260 to form it into identical adjoining linear segments 212 whereby a substantially identically constructed succession of angularly off-set linear tape segments 212 are ensured. Thus, a uniformly controlled stacking of the turns of coil 211 in collapsed compact condition is obtained to ensure that the correspondingly spaced barb clusters are nested in face-to-face contact engagement with correspondingly aligned confronting clusters of the adjoining connected turns of coil 211. As illustrated in FIG. 7, each barb cluster may be formed intermediate the ends of its respective linear segment 212 at a point midway between its ends to ensure the desired precision stacking of successive turns of the coil in a collapsed condition.

While the material and the details of the coil 211 have been described with specific reference to the preferred illustrated embodiment, it is to be understood that the coil may be formed of any material combining the required properties of producibility, extensibility, retractability, and structural strength required for obstruction and obstacle functioning. It is contemplated that, in addition to metal, other materials such as plastics are capable of being employed. Moreover, other specific basic entanglement constructions may be utilized such as a single coil concertina, e.g., with barbed metal tape fitted around a spring steel core wire.

Furthermore, to provide a barrier which can be readily recovered for repeated use and which is particularly suited for rapid deployment under emergency conditions and is thereafter retractable for re-use into a compact nested, collapsed stack in a facile manner, the barrier coil 211 may include rigid and permanent point attachments of each intermediate coil turn, between the end turns, to adjacent trailing and leading coil turns in circumferentially spaced succession about each such intermediate coil turn. In some embodiments, these points of attachment comprise an odd number of approximately equiangularly spaced points throughout each intermediate coil turn of 360°. Such construction, when coupled with the previously described oriented protrusions, which are constructed to avoid any mutual interference, positively insures that precision orientation is maintained even upon coil deployment, whereby any relative longitudinal movement or slipping or twisting of the adjacent coils at their points of attachment is prevented.

To control the maximum length of an obstacle upon extending or deploying coil 211 and to insure a deployed coil minimum diameter whereby a continuous length of the strip material, even when stretched, exhibits a relatively uniform radius of curvature, a relatively stiff spacer device 252 may be provided. The spacer device 252 should have sufficient strength and flexibility to provide repeated extension and retraction while bearing required obstacle dispensing loads. Such construction additionally necessitates a relatively stiff spacer to minimize any potential deflection and consequent undesired entanglement with adjacent spacer devices or with any coil protrusions (such as the illustrated barbs) to insure that the full and appropriate length of the extended barrier coil 211 is realized.

Figure 8:
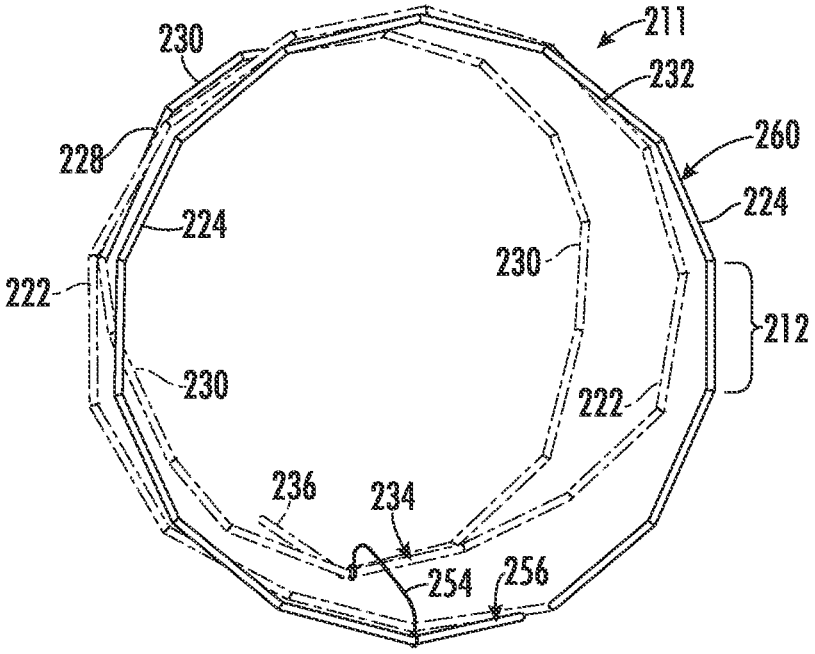
Figure 9:
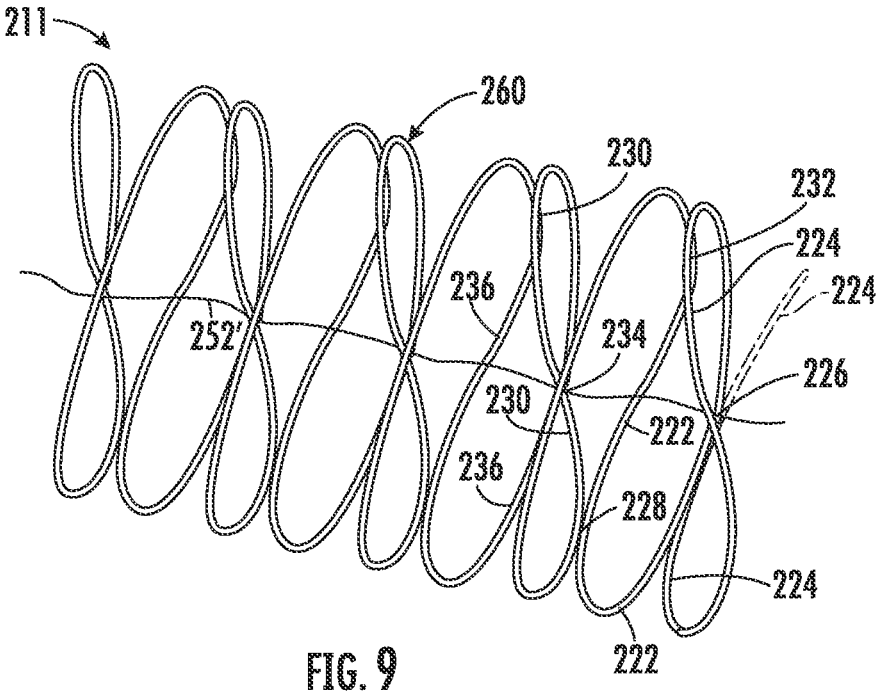
Figure 10:
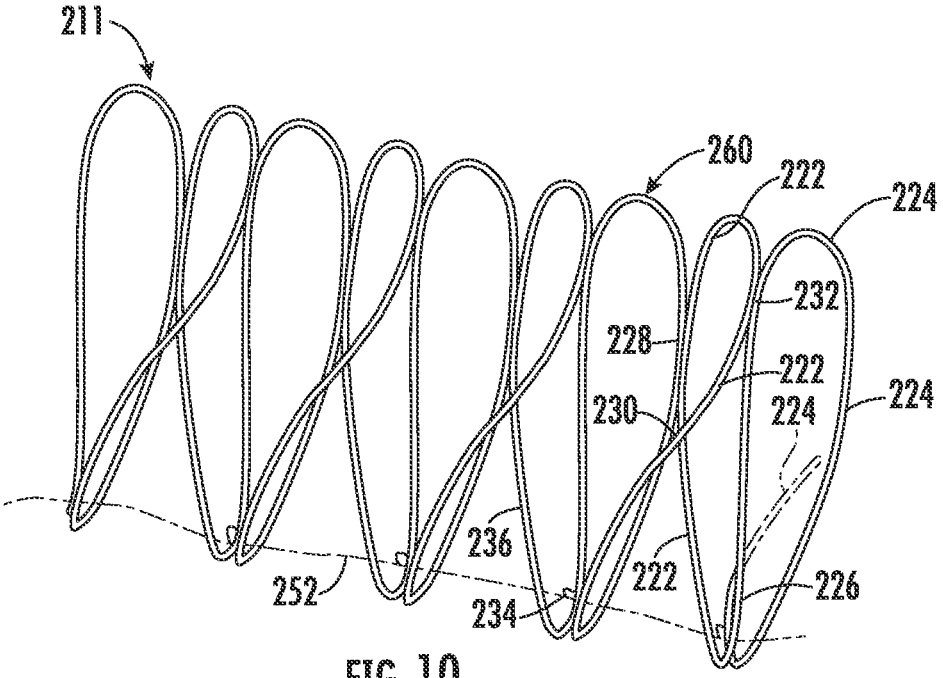
Figure 11:
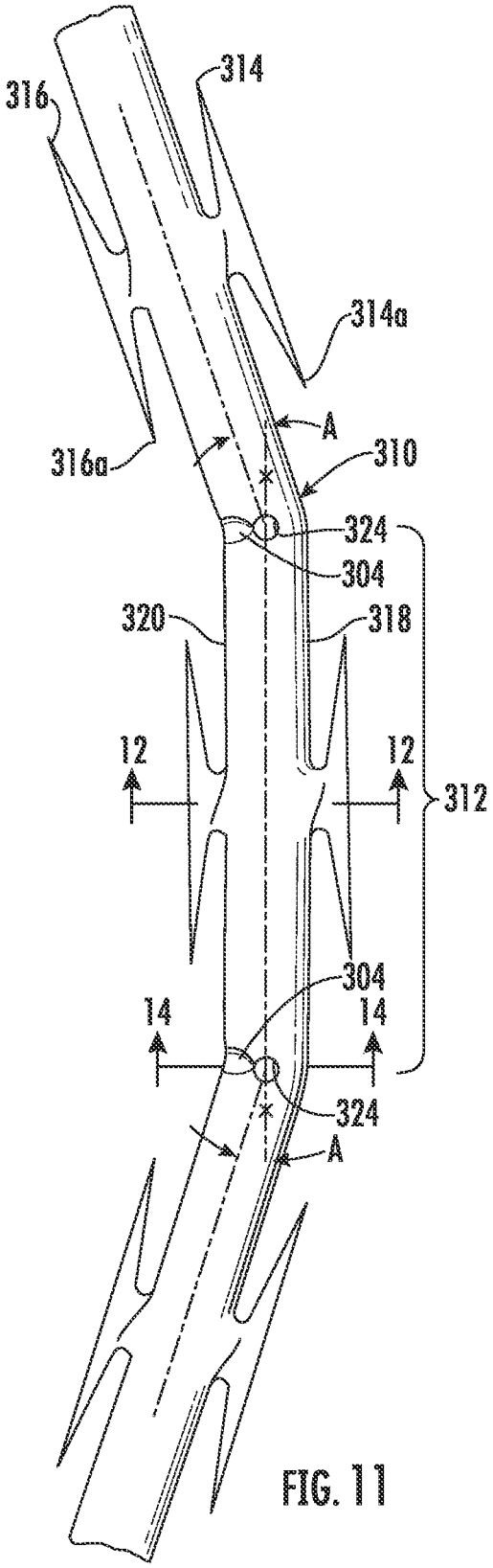
FIGS. 11-15 demonstrate another razor wire according to exemplary approaches of the disclosure.
Figure 12:
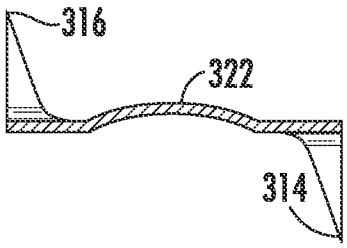

In reference to FIGS. 8-10, a first intermediate coil turn 222 (in leading relation to a trailing end turn 224 and described in FIGS. 9 and 10 from right to left) may have an initial base point of attachment 226 to trailing end turn 224, a second point of attachment 228 to a leading intermediate coil turn 230, and a third point of permanent attachment 232 to trailing end turn 224 prior to the next circumferentially successive base point of attachment 234 of intermediate coil turn 222 to leading intermediate coil turn 236. Intermediate coil turn 236 and successive connected intermediate coil turns are likewise each alternately permanently attached to adjacent leading and trailing turns at spaced points throughout the coil length.

The number of points of rigid permanent attachment between adjacent coil turns may be varied depending upon whether the barrier provided is to be used for animal or human control purposes, as well as upon the desired size of the coil diameter when deployed and the like. In some embodiments, an odd number of permanent attachment points are employed for each coil turn. Examples of the number of attachment points which have been found to provide satisfactory results have ranged from three attachment points for each 360° turn for a collapsed coil 211 having an approximately 24 inch diameter to, e.g., nine attachment points for a 360° coiled turn for a 48 inch collapsed diameter coil. Since each of the adjacent turns are absolutely secured in fixed relation to one another at their points of attachment, precise nesting of coil 211 is possible.

Turning now to FIGS. 11-15, a barbed tape 310 according to embodiments of the present disclosure will be described. It will be appreciated that the barbed tape 310 may be used with the assembly 100 described above. As shown, the barbed tape 310 is fabricated from linear, substantially planar, flat metal strip stock. The barbed tape 310 has a continuous series of closed loops or turns defining a helical coil 311 with each closed turn having adjoining equiangularly offset linear segments of equal length such as at 312. Each turn of coil 311 is so formed as to be readily collapsed into stacked confronting nesting relation to its adjoining connected turns.

The barbed tape 310 preferably is shown with barb clusters each providing four needle-sharp barbs with each four-barb cluster having two barb pairs 314, 314*a* and 316, 316*a* spaced opposed along opposite tape edges 318 and 320. For example, each barb pair may be, e.g., 2⅜ inch long and equally spaced apart on 4-inch centers repeatedly along the length of the barbed tape 310 dimensioned, e.g., to be 0.025 inch thick and about 1.195 inch wide at the maximum width of the tape across barbs and fabricated for general purpose use, say, with 24 and 30 inch diameter turns. Such barbed tape 310 may be fabricated from flat strip stock of high carbon steel and is particularly suited to be formed from austenitic stainless steel 0.025 inch thick, e.g., hardened to Rockwell 30 N, 50-70.

Figure 13:
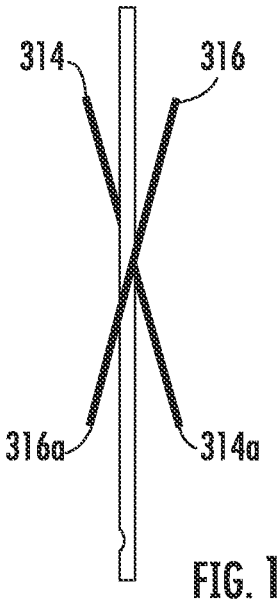
Figure 14:
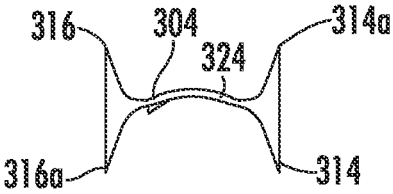

The barbs of each pair 314, 314*a* and 316, 316*a* respectively extend in opposite directions longitudinally of the barbed tape 310 with barb pair 314, 314*a* of each cluster reversely oriented relative to barb pair 316, 316*a* in inclined relation to the plane of the barbed tape 310, as demonstrated in FIG. 13. Barbed tape 310 may also fabricated to provide a crown 322 (FIG. 12) in the plane of the barbed tape 310 such that the finished tape in cross section curves to promote nesting of stacked turns when the barbed tape 310 is collapsed as well as to effectively resist deformation when installed in extended condition. The plane of the crowned, but substantially planar barbed tape 310, will be understood to be that plane containing the longitudinally extending outside and inside tape edges 318 and 320.

Figure 15:
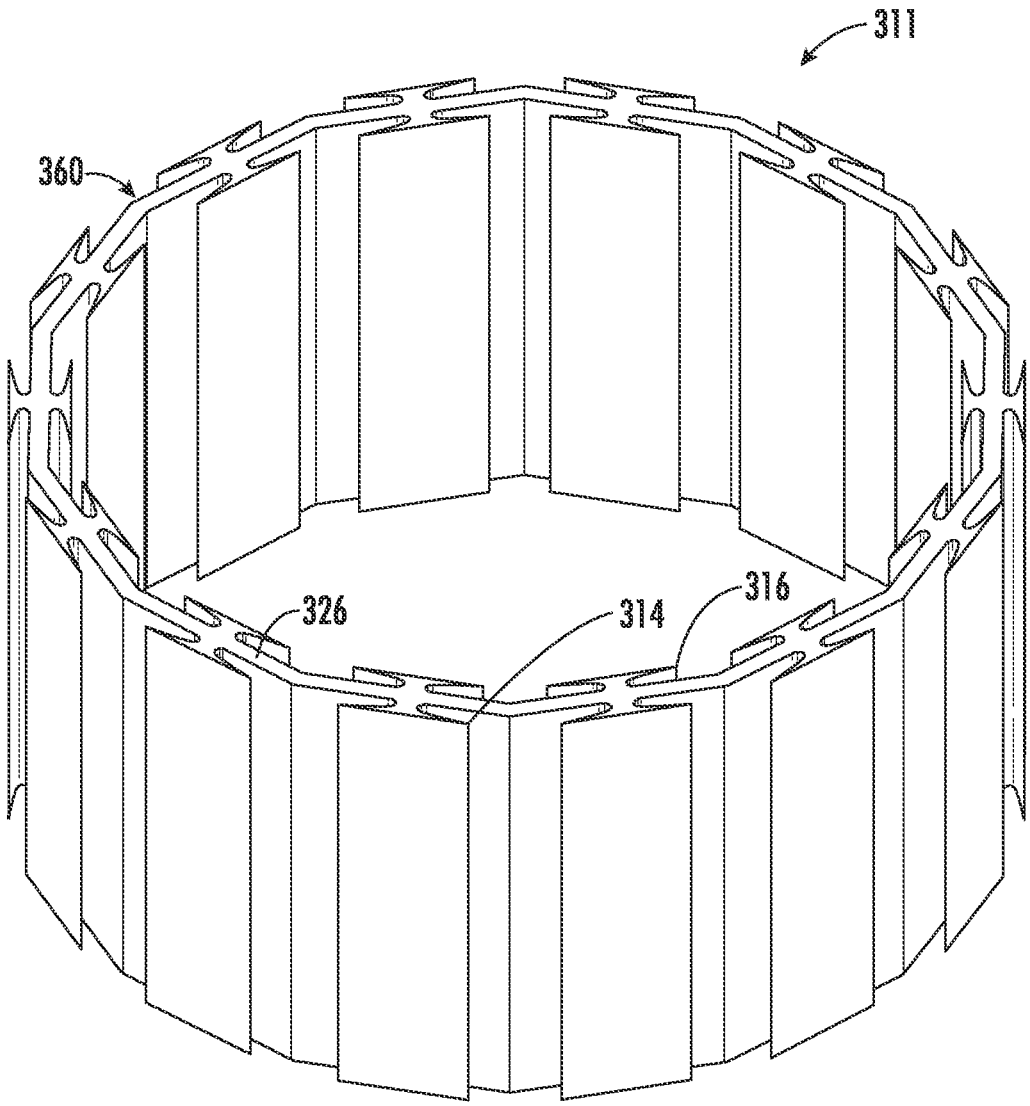

The barb clusters are positioned in precise corresponding relation to one another along each turn of coil 311 such that linear segments 312 and their barb clusters of each closed turn of the coil may be positioned in face-to-face contact engagement with corresponding elements of their connected adjacent turns throughout their entire length when the turns are collapsed to nest in an axially aligned arrangement, as best seen in FIG. 15.

To make barbed tape 310, which may be readily fabricated, even from the above described resilient spring steel, in an efficient high production, low cost operation to form a helical coil 311 of maximum effectiveness, the linear strip stock may be first edge trimmed to form the barb clusters which are then reversely oriented into inclined relation to the plane of the tape. After the strip is formed with oriented barbs, the strip is then edge bent in the plane of the barbed tape 310 to form it into identical adjoining linear segments.

Although non-limiting, the barbed tape 310 may include openings or holes 324 located midway between successive barb clusters with the holes 324 being equally spaced apart and located on a central or major longitudinal axis X-X of the barbed tape 310. Such construction not only provides relief for deformation of the barbed tape 310 into a closed loop without tearing the metal incident to edge bending of the barbed tape 310 about each of its holes 324 along a transverse line intersecting hole 324, but additionally work hardens bend zones of the barbed tape 310 surrounding each bend forming opening or hole 324.

More specifically, to preclude unacceptable tearing of barbed tape 310 in each bend zone as well as to ensure that the metal in each bend zone is identically formed, the bend forming holes 324 in each bend zone are formed in a circular shape of controlled equal diameter. Such construction has been found through experimentation to not only establish bend zones between adjoining tape segments of uniformly formed configuration but additionally provide consistent metal flow about holes 324 during such an edge bending operation to ensure a substantially identically constructed succession of angularly offset linear tape segments 312.

The metal in each bend zone between its bend forming hole 324 and outside tape edge 318 is stretched while the metal between each hole 324 and its adjacent inside tape edge 320 is compressed to form a dimple 304 in each bend zone. The controlled dimensioning and location of holes 324 and edge bending of each segment in the plane of the barbed tape 310 about its bend forming hole 324 through a precisely identical bend angle "A" serves to ensure the formation of dimples 304 of substantially identical configuration for uniformly controlled stacking of the turns of coil 311 in collapsed condition. Upon collapsing a completely formed coil, the dimples 304 in each bend zone thus are nested in contact engagement with corresponding dimples of aligned bend zones (FIG. 15) of the adjoining connected turns of coil 311.

In one non-limiting embodiment of the barbed tape 310 of this embodiment, the tape 310 is formed from the above described strip of austenitic stainless steel 0.025 inch thick, hardened to Rockwell 30 N 50-70, and dimensioned to be 0.600±0.050 inch wide at its narrowest width along the trimmed edges of barbed tape 310, specifically as dimensioned across the bend zone between adjoining tape segments 312. A bend forming hole 324 of 0.200 inch diameter is formed at each bend zone on the central longitudinal axis X-X of its tape segment 312. Accordingly, the ratio of the tape width at each bend zone to the diameter of its bend forming opening varies from about 2.75 to about 3.25 or is about 3 to 1 with the ratio of width of the tape to its thickness being established at about 24 to 1.

It has been found that a tape of the above described construction during the edge forming operation tempers itself and is full hardened in the bend zone. It has also be found through experimentation that with a tape having the above described dimensional relationships, holes 24 of reduced diameter have been found to result in tearing of the tape at its bend zones and that holes of larger diameter than that described have weakened the bend zone sufficiently to result in tape coils of unacceptable quality.

While the dimensioning described for the specifically identified stainless steel strip stock is not as critical, e.g., for soft carbon steel, nonetheless, the provision of the bend forming opening between adjoining linear tape segments 312 does serve to control "dimpling" and, therefore, desired precision stacking of successive turns of the coil in a collapsed condition.

Accordingly, a coiled tape of the described construction not only has a succession of bend zones with bend forming holes therein of controlled uniform size, but the described tape construction establishes controlled metal flow at each bend zone to provide work hardened areas at the bend which become "full hardened" because of the severe work hardening effected by the edge bending process. The individual bend zones thus are each controlled during fabrication, and successive adjoining turns of the coil are accordingly controlled and dimensioned to ensure compact aligned stacking of each turn in face-to-face engagement with corresponding elements of confronting adjoining turns of the coil in a quality product particularly suited for reliable performance over an extended period of time under rugged conditions.

Figure 16:
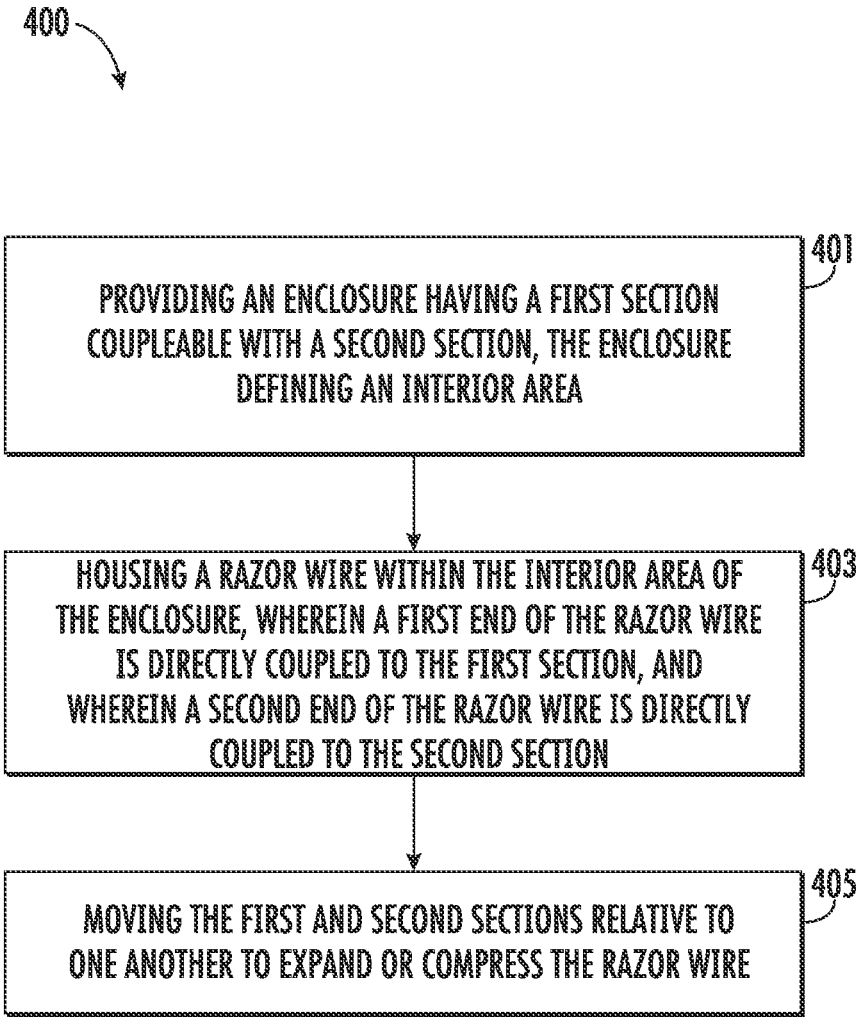
FIG. 16 is a flow chart of a method for deploying the razor wire RDU of FIG. 1 according to exemplary approaches of the disclosure.

Turning now to FIG. 16, a method 400 according to embodiments of the disclosure will be described in greater detail. At block 401, the method 400 may include providing an enclosure having a first section coupleable with a second section, the enclosure defining an interior area therein. At block 403, the method 400 may include housing a razor wire within the interior area of the enclosure, wherein a first end of the razor wire is directly coupled to the first section, and wherein a second end of the razor wire is directly coupled to the second section. In some embodiments, the first end of the razor wire may be coupled to a first mesh panel extending across the first section, and the second end of the razor wire may be coupled to a second mesh panel extending across the second section.

At block 405, the method may include moving the first and second sections relative to one another to expand or compress the razor wire. In some embodiments, the second section may first be secured in place, for examples, using an anchor component rotatably coupled to the second section. The first section may then be separated away from the second section to expand the razor wire.

Although not described herein for the sake of brevity, one of skill in the art will recognize many variations are possible within the scope of the present embodiments. For example, variations may include the shape of the enclosure, location of attached wheels, base configuration, attachment methods of concertina wire to the enclosure, securing of two enclosure halves to each other, size of the enclosure and the concertina wire used, the material that the enclosure is manufactured from, features that may add rigidity to the enclosure, handle configurations, accessories that may or may not be included with the concertina wire, and so on.

The foregoing discussion has been presented for purposes of illustration and description and is not intended to limit the disclosure to the form or forms disclosed herein. For example, various features of the disclosure may be grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other.

Furthermore, the terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, the present disclosure has been described herein in the context of a particular implementation in a particular environment for a particular purpose. Those of ordinary skill in the art will recognize the usefulness is not limited thereto and the present disclosure may be beneficially implemented in any number of environments for any number of purposes. Thus, the claims set forth below are to be construed in view of the full breadth and spirit of the present disclosure as described herein.

What is claimed is:

1. A razor wire rapid deployment unit (RDU), comprising:
an enclosure having a first section coupleable with a second section;
a razor wire, wherein a first end of the razor wire is directly coupled to the first section, wherein a second end of the razor wire is directly coupled to the second section, and wherein the first and second sections of the enclosure are separable from one another to bias the razor wire between a compressed configuration and an expanded configuration; and
an anchor component rotatably coupled to an exterior of the second section, wherein the anchor component comprises:
a first tube; and
a second tube rotatably coupled to the first tube, wherein the second tube is fixed in a perpendicular orientation relative to the first tube, wherein in a first configuration of the anchor component the second tube extends parallel to a plane defined by an outer surface of the second section, and wherein in a second configuration the second tube extends perpendicular to the plane defined by the outer surface of the second section.

2. The razor wire RDU of claim 1, the first section comprising:
a first outer frame; and
a first mesh panel extending across the first outer frame, wherein the first end of the razor wire is directly coupled to the first mesh panel.

3. The razor wire RDU of claim 2, the first section further comprising a receptacle extending through the first mesh panel and into an interior area of the enclosure.

4. The razor wire RDU of claim 2, further comprising a wire support extending from the first mesh panel, wherein the razor wire is retained on the wire support when the razor wire is in the compressed configuration.

5. The razor wire RDU of claim 1, further comprising a transport frame directly coupled to an exterior surface of the first section of the enclosure, the transport frame comprising:
a base frame coupled to a lower portion of the first section of the enclosure, wherein a set of wheels is coupled to the base frame; and
a main frame coupled to the base frame, the main frame extending vertically between the lower portion and an upper portion of the first section of the enclosure.

6. The razor wire RDU of claim 5, wherein the main frame extends above the upper portion of the first section of the enclosure.

7. The razor wire RDU of claim 1, wherein a free end of the anchor component is secured to the exterior of the second section when the anchor component is in the first configuration, and wherein the free end of the the anchor component extends away from the second section when the anchor component is in the second configuration.

8. An assembly, comprising:
an enclosure having a first section detachably coupled to a second section;
a concertina razor wire housed within an interior area of the enclosure, wherein a first end of the concertina razor wire is directly coupled to the first section, and wherein a second end of the concertina razor wire is directly coupled to the second section; and
an anchor component coupled to the second section, wherein the anchor component comprises:
a first component; and
a second component rotatably coupled to the first component, wherein the second component is fixed in a perpendicular orientation relative to the first component, wherein in a first configuration of the anchor component the second component extends parallel to a plane defined by an outer surface of the second section, and wherein in a second configuration the second component extends perpendicular to the plane defined by the outer surface of the second section.

9. The assembly of claim 8, the first section comprising:
a first outer frame; and
a first mesh panel extending across the first outer frame, wherein the first end of the concertina razor wire is directly coupled to the first mesh panel.

10. The assembly of claim 9, the first section further comprising a receptacle extending through the first mesh panel and into the interior area of the enclosure.

11. The assembly of claim 9, further comprising a wire support extending from the first mesh panel, wherein the concertina razor wire is retained on the wire support when the concertina razor wire is compressed.

12. The assembly of claim 8, further comprising a transport frame directly coupled to an exterior surface of the first section of the enclosure, the transport frame comprising:
a base frame coupled to a lower portion of the first section of the enclosure, wherein a set of wheels is coupled to the base frame; and
a main frame coupled to the base frame, the main frame extending vertically between the lower portion and an upper portion of the first section of the enclosure.

13. The assembly of claim 8, wherein a panel of the second section comprises a second mesh panel extending across a second outer frame, and wherein the second end of the concertina razor wire is directly coupled to the second mesh panel.

14. A method of deploying a razor wire, comprising:
providing an enclosure having a first section coupleable with a second section;
housing the razor wire within an interior area of the enclosure, wherein a first end of the razor wire is directly coupled to the first section, and wherein a second end of the razor wire is directly coupled to the second section;

securing the second section in place using an anchor component rotatably coupled to the second section, wherein the anchor component comprises:

a first cross support and a second cross support extending across the second section;

a first tube extending between the first and second cross supports; and a second tube rotatably coupled to the first tube, the second tube extending perpendicular to the first tube, wherein in a first configuration the second tube extends parallel to a plane defined by an outer surface of the second section, and wherein in a second configuration the second tube extends perpendicular to the plane defined by the outer surface of the second section; and moving the first section relative to the second section to deploy the razor wire from the interior area of the enclosure.

15. The method of claim 14, further comprising coupling the first end of the razor wire to a first mesh panel of the first section, and coupling the second end of the razor wire to a second mesh panel of the second section.

* * * * *